US007419232B2

(12) United States Patent
Hoshino

(10) Patent No.: US 7,419,232 B2
(45) Date of Patent: Sep. 2, 2008

(54) INKJET PRINTER

(75) Inventor: Yoshihide Hoshino, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 323 days.

(21) Appl. No.: 11/190,563

(22) Filed: Jul. 27, 2005

(65) Prior Publication Data

US 2006/0023026 A1 Feb. 2, 2006

(30) Foreign Application Priority Data

Aug. 2, 2004 (JP) ..... 2004-225516

(51) Int. Cl.
*B41J 29/38* (2006.01)
*B41J 2/01* (2006.01)

(52) U.S. Cl. ..... 347/5; 347/14; 347/102

(58) Field of Classification Search ..... 347/15, 347/41, 102, 5, 43, 14
See application file for complete search history.

(56) References Cited

U.S. PATENT DOCUMENTS 6,273,549 B1 * 8/2001 Wetchler et al. ..... 347/43
6,834,948 B2 * 12/2004 Asano et al. ..... 347/102
7,080,900 B2 * 7/2006 Takabayashi et al. ..... 347/102
7,182,453 B2 * 2/2007 Nakajima ..... 347/102
2003/0112282 A1 * 6/2003 de Pena ..... 347/5

FOREIGN PATENT DOCUMENTS

JP 07-195715 8/1995
JP 2001-310454 A 11/2001
JP 2003-025613 A 1/2003

* cited by examiner

*Primary Examiner*—Julian D. Huffman
*Assistant Examiner*—Jason S Uhlenhake
(74) *Attorney, Agent, or Firm*—Frishauf, Holtz, Goodman & Chick, P.C.

(57) ABSTRACT

An inkjet printer includes a plurality of recording heads for jetting inks of a plurality of kinds onto a recording medium, a light emitting device for irradiating light onto ink having reached the recording medium, a driving device for moving the plurality of recording heads and the recording medium relatively and bidirectionally, and a control device for performing control to form an image by controlling the plurality of recording heads to jet ink while moving the plurality of recording heads and the recording medium relatively in one direction and in an opposite direction, and changing ink jetting amounts to be jetted from the respective recording heads, depending on whether jetting ink while the recording heads are moving in the one direction or in the opposite direction, so that the same color is formed in the both moving directions of the recording heads.

8 Claims, 5 Drawing Sheets

FIG. 4

| INPUT VALUE | OUTPUT VALUE |
|---|---|
| 0 | 0 |
| 1 | 0.003 |
| 2 | 0.007 |
| 3 | 0.010 |
| 4 | 0.012 |
| 5 | 0.015 |
| ⋮ | ⋮ |
| 64 | 0.150 |
| ⋮ | ⋮ |
| 128 | 0.250 |
| ⋮ | ⋮ |
| 192 | 0.500 |
| ⋮ | ⋮ |
| 255 | 1.000 |

FIG. 5

| MATERIAL TYPE | CORRECTION COEFFICIENT |
|---|---|
| A | 1.00 |
| B | 0.95 |
| C | 0.75 |
| D | 0.90 |

FIG. 6

| INK TYPE | INK CORRECTION COEFFICIENT ON INK |
|---|---|
| A | 1.20 |
| B | 1.10 |
| C | 1.15 |
| D | 1.05 |

| MAIN SCANNING SPEED | A COEFFICIENT | B COEFFICIENT |
|---|---|---|
| 200mm / sec | 0.90 | 0.95 |
| 400mm / sec | 1.00 | 1.05 |
| 600mm / sec | 1.05 | 1.10 |
| 800mm / sec | 1.10 | 1.15 |

INKJET PRINTER

This application is based on Japanese Patent Application No. 2004-225516 filed on Aug. 2, 2004, in Japanese Patent Office, the entire content of which is hereby incorporated by reference.

FIELD OF THE INVENTION

The present invention relates to an inkjet printer, and particularly relates to an inkjet printer using ink curable by irradiating UV light.

BACKGROUND OF THE INVENTION

In recent years, allowing production of images more easily and less expensively than a gravure printing method, the inkjet recording method is applied to various fields of printing including photographing, various printing, special printing such as marking and color filtering. Particularly, inkjet recording allows it to obtain an image quality comparable to a silver halide photograph by a combination of an inkjet printer with an inkjet recording method that jets and controls fine dots, inks having an improved color reproduction area, durability, jettability, etc., and a dedicated paper with a significantly improved ink absorbency, color developability of a color material, surface gloss, etc.

There are known inkjet printers such as a line type which performs image recording by jetting ink from line-heads formed with a plurality of jetting nozzles disposed in the scan direction (recording direction) orthogonal to a conveying direction on a recording medium conveyed in the conveying direction, and a serial type which performs image recording by jetting ink from jetting nozzles of recording heads while moving the recording heads mounted on a carriage in the scan direction (recording direction).

Further, inkjet printers can be categorized by types of ink. That is, there are known inkjet printers such as a phase change inkjet type using wax inks in a solid state at a room temperature, a solvent inkjet type using inks based on a quick drying organic solvent, a UV curing inkjet type using UV curable inks which are cured by irradiating UV light, and so on. Particularly, a UV curing inkjet type makes less smell compared with other recording types, and are paid attention to because it allows recording on a recording medium which is not quick drying or ink absorbent, in addition to dedicated papers (for example, see Patent Document 1).

Further, in recent years, an inkjet printer of a serial type, as described above, jets ink from recording heads not only while a carriage is moving in one direction, namely, a scanning direction, but also while the carriage is moving in the back direction opposite to the scanning direction, which achieves image recording at a high speed.

Incidentally, to form a color image by an inkjet printer, inks in plural colors are jetted superimposedly onto a recording medium to express a special color. However, in the case where ink is jetted during both forward moving and backward moving of a carriage in an inkjet printer of a serial type as described above, the jetting order is reversed by the moving direction, namely forward moving and backward moving of the carriage. Accordingly, even when inks in plurality of colors are jetted in the same combination and amount, a problem occurs in that the color looks different depending on whether the inks are jetted during forward motion or the backward motion.

Therefore, there have been offered inkjet printers in which plural recording heads mounted on a carriage are disposed such that the colors of inks are symmetric so that the jetting order is not changed by forward motion and backward motion (for example, see Patent Document 2).

Further, for an inkjet printer using drainage inks, there have been offered methods which change the ink jetting amount with the moving direction, namely, the forward motion or the backward motion of the carriage, correspondingly to the degree of penetration of ink into a recording medium (for example, see Patent Document 3).

[Patent Document 1] TOKKAI No. 2001-310454

[Patent Document 2] U.S. Pat. No. 3,248,704

[Patent Document 3] TOKKAI No. 2003-25613

However, in accordance with Patent Document 2 described above, the number of recording heads are approximately double that of a printer which jets ink only during forward motion, which forces a printer to have a larger size.

In the case of drainage inks as described in Patent Document 3, since ink penetrates into a recording medium, even when an ink in a different color is jetted superimposed over an ink having been jetted, it is possible to calculate a proper ink amount, taking the relationship between the ink and the recording medium into account. In the case of photo-curable ink, since ink does not penetrate into a recording medium, when jetting an ink in a different color onto an ink having been jetted, not only the relationship between the ink and the recording medium, but also the relationship between the ink to be jetted and the ink having been jetted, landed on the recording medium, and got photo-cured is needed to be taken into account, which has not been considered before. Therefore, the technology disclosed in Patent Document 3 cannot be applied to an inkjet printer using photo-curable ink.

SUMMARY OF THE INVENTION

An object of the invention is to provide an inkjet printer using photo-curable ink, wherein the printer can form the same colors in both one direction and the opposite direction, in terms of the recording direction, and accordingly allows desirable image forming.

In an aspect of the invention, an inkjet printer includes a plurality of recording heads for jetting inks of a plurality of kinds onto a recording medium, a light emitting device for irradiating light onto ink having reached the recording medium, a driving device for moving the plurality of recording heads and the recording medium relatively and bidirectionally, and a control device for performing control to form an image by controlling the plurality of recording heads to jet ink while moving the plurality of recording heads and the recording medium relatively in one direction and in an opposite direction, and changing ink jetting amounts to be jetted from the respective recording heads, depending on whether jetting ink while the recording heads are moving in the one direction or in the opposite direction, so that the same color is formed in the both moving directions of the recording heads.

BRIEF DESCRIPTION OF THE DRAWINGS

FIG. 4 is a diagram specifically showing contents of information in an image correction table related to tone correction processing by the inkjet printer in FIG. 1;

FIG. 5 is a diagram specifically showing contents of information of recording medium correction data related to the tone correction processing by the inkjet printer in FIG. 1;

FIG. 6 is a diagram specifically showing contents of information of ink property correction data related to the tone correction processing by the inkjet printer in FIG. 1;

DETAIL DESCRIPTION OF THE PREFERRED EMBODIMENT

Figure 1:
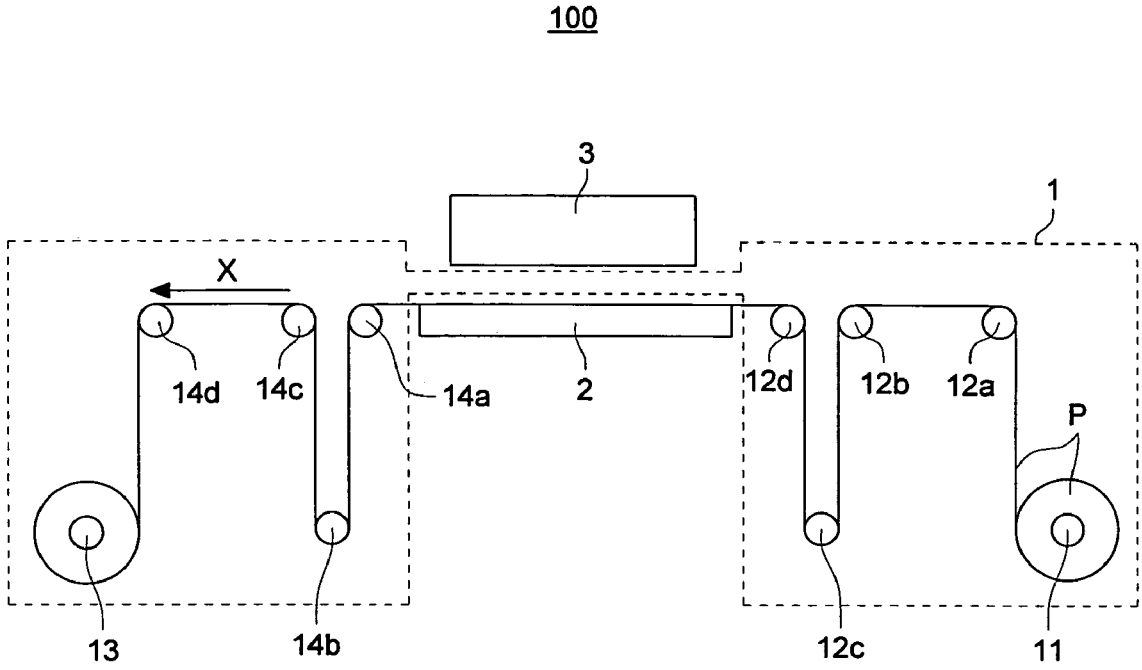
FIG. 1 is a schematic diagram showing an inkjet printer as an example in a first embodiment in accordance with the invention.

The invention includes the following structures.

Item 1. An inkjet printer includes a plurality of recording heads for jetting inks of a plurality of kinds onto a recording medium, a light emitting device for irradiating light onto ink having reached the recording medium, a driving device for moving the plurality of recording heads and the recording medium relatively and bidirectionally; and a control device for performing control to form an image by controlling the plurality of recording heads to jet ink while moving the plurality of recording heads and the recording medium relatively in one direction and in an opposite direction, and changing ink jetting amounts to be jetted from the respective recording heads, depending on whether jetting ink while the recording heads are moving in the one direction or in the opposite direction, so that the same color is formed in the both moving directions of the recording heads.

According to the structure of Item 1, it is possible to form the same color both in one recording direction and the opposite recording direction.

Item 2. In the inkjet printer of Item 1, the control device performs control to form an image by repeating the following control. At least one of the plurality of recording heads jets an ink onto the recording medium having an already cured ink and the light emitting device cures the ink while the plurality of recording heads and the recording medium are relatively moving in the one direction, and at least one of the plurality of recording heads jets an ink onto the recording medium having an already cured ink and the light emitting device cures the ink while the plurality of recording heads and the recording medium are relatively moving in the opposite direction. Herein, the control device changes an ink jetting amount depending on whether jetting the ink while the recording heads are moving in the one direction or in the opposite direction, corresponding to wettabilities of ink and the recording medium.

According to the structure of Item 2, it is possible to securely form the same color both in one recording direction and the opposite recording direction.

Item 3. In the inkjet printer of item 2, the control device performs control to correct tones of image data, corresponding to the wettabilities of ink and the recording medium.

According to the structure of Item 3, it is possible to further securely form the same color both in one recording direction and the opposite recording direction, particularly for halftones.

Item 4. In the inkjet printer of any one of Items 1 to 3, the control device performs control to change the ink jetting amounts depending on whether jetting the inks while the recording heads are moving in the one direction or in the opposite direction, corresponding to a relative moving speed between the plurality of recording heads and the recording medium.

According to the structure of Item 4, it is possible to still further securely form the same color both in one recording direction and the opposite recording direction.

According to the invention, the inkjet printer can form the same colors during both in one recording direction and the opposite recording direction so as to form desirable images.

A preferred embodiment in accordance with the invention will be described below, referring to the drawings. However, the invention is not limited to the examples shown in the figures.

FIG. 1 is a schematic diagram showing an inkjet printer as an example in a first embodiment in accordance with the invention.

As shown in FIG. 1, an inkjet printer 100 is a serial type inkjet printer including a conveying mechanism 1 for conveying a recording medium P along a conveying path, a platen 2 for supporting the recording medium P conveyed by the conveying mechanism 1, by sucking the recording medium P at the top surface of the platen, an image recording device 3 for recording an image on the recording surface of the recording medium P supported by the platen 2, and a control device 4 (refer to FIG. 3) for integrally controlling these units.

The conveying mechanism 1 is arranged on the upstream side of the platen 2 in conveying direction X of the recording medium P, and includes a feed-out roller 11 around which a recording medium P having a long length and a predetermined width is wound, four upstream-side driven rollers 12*a* to 12*d* arranged between the feed-out roller 11 and the platen 2 to guide the recording medium P sent out from the feed-out roller 11, a winding roller 13 arranged on the downstream side of the platen 2 in conveying direction X to wind the recording medium P sent out from the feed-out roller 11, four downstream side driven rollers 14*a* to 14*d* arranged between the platen 2 and the winding roller 13 to guide the recording medium P on which image recording has been performed by the image recording device 3, and a driving source (not shown) including a conveying motor for rotationally driving the winding roller 13.

The conveying mechanism 1 in such a structure rotates the winding roller 13 by the driving source and allows intermittent conveying of the recording medium P in conveying direction X, under the control of a control device 4.

Herein, the recording medium P used in the present embodiment can be various papers such as a plain paper employed by a common inkjet printer, recycled papers, various papers such as gloss papers, various cloths, various nonwoven cloths, resins, metals, glasses, etc. As the form of the recording medium P, forms such as a roll form, cut-sheet form, plate form can be applied.

Particularly, as the recording medium P used in the present embodiment, a resin film used for so-called soft packaging which is transparent or opaque, and non-absorbent can be applied. Specifically, it is possible to apply a polyethylene terephthalate, polyester, polyolefine, polyamide, polyester amide, polyether, polyimide, polyamidoimide, polystyrene, polycarbonate, poly-ρ-phenylene sulfide, polyether ester, polyvinylchloride, poly (meth) acrylate ester, polyethylene, polypropylene, nylon, etc. Further, it is also possible to apply copolymers of these resins, mixtures of these resins, bridges between these resins, and the like. Especially, it is preferable to select one of polyethylene terephthalates, polystyrene, polypropylens, and nylon which are stretched, as a type of resin of the resin film, in respect of transparency, dimensional stability, rigidity, environmental load, cost, etc. of the resin film. It is also preferable to use a resin film having a thickness of not smaller than 2 μm and not greater than 100 μm (more preferably not smaller than 6 μm and not greater than 50 μm). Further, surface treatment, such as corona discharge treatment and easy adhesion treatment, may be performed on the surface of the base of the resin film.

Still further, it is possible to apply a known opaque recording medium P such as various papers coated with a resin, a film containing a pigment, a urethane film, as the recording medium P used in the present embodiment.

The platen 2 is arranged approximately horizontally, for example, and is supported by the top surface of the platen 2 such that the bottom surface (the surface on the opposite side to the surface on the recording side) of the recording medium P in a predetermined range is sucked by driving a sucking unit, not shown.

The image recording device 3 is provided above the platen 2.

Next, the image recording device 3 will be described in detail, referring to FIG. 2.

Figure 2:
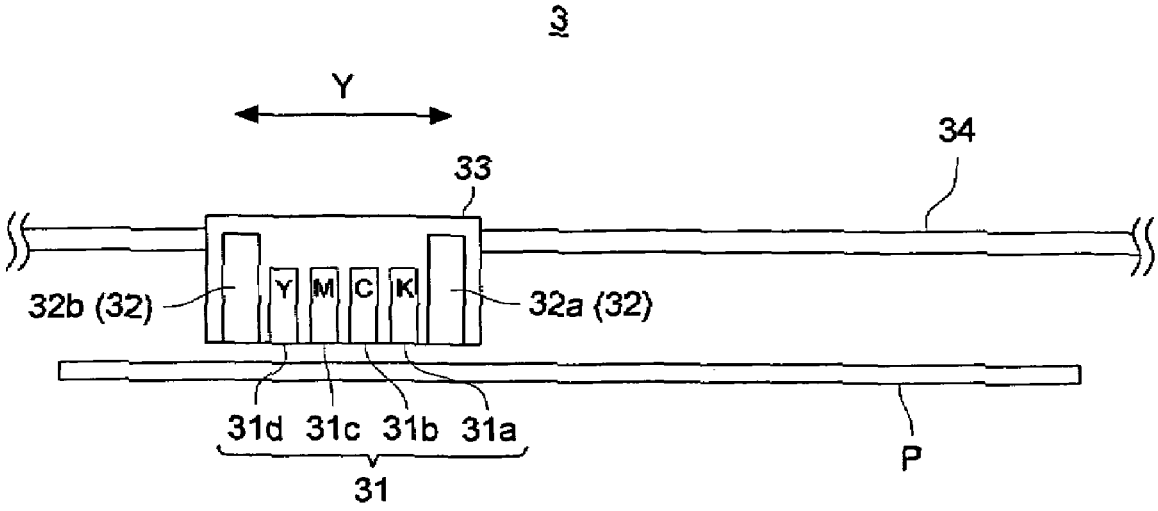
FIG. 2 is a side view showing a main structure of an image recording device of the inkjet printer in FIG. 1.

Herein, FIG. 2 is a side view showing a main structure of the image recording device 3.

As shown in FIG. 2, the image recording device 3 includes recording heads 31 for jetting inks having a characteristic of being cured by irradiating UV light as light, from discharging openings of nozzles onto the recording surface of the recording medium P, light emitters 32 for projecting UV light onto ink having been jetted onto the recording surface and reached there, a carriage 33 for mounting and supporting these recording heads 31 and light emitters 32, and a carriage rail 34 extending along scanning direction (recording direction) Y. In the present embodiment, a driving device is structured such that it moves a plurality of recording heads and a recording medium relatively and bidirectionally, by the carriage 33, the carriage rail 34, the driving source (not shown), etc.

The carriage 33 is movable in scanning direction Y, guided by the carriage rail 34. The moving direction of the carriage 33 is changed according to the rotation direction of the driving source, which makes the reciprocal motion in bidirectional directions, namely one direction and the opposite direction, along scanning direction Y. In image recording, while the recording medium P is stopping, the carriage 33 moves forward in one direction along scanning direction Y and moves backward in the opposite direction, or reciprocally moves bidirectionally, during which the recording heads 31 and the light emitters 32 work to record an image on the recording medium P. In other words, image recording is performed by the image recording device 3 in a serial method.

Incidentally, in the present embodiment, scanning direction Y is orthogonal to conveying direction X of the recording medium P, that is, the width direction of the recording medium P.

The recording heads 31 are provided in a quantity of four, corresponding to the inks in four colors (for example, yellow (Y), magenta (M), cyan (C), black (K)) used by the inkjet printer 100, wherein these four recording heads 31*a* to 31*d* are disposed along scanning direction Y from the left side to the right side in FIG. 2.

Each recording head 31 is provided, on its bottom surface, with a nozzle surface formed with discharging openings (not shown) of a plurality of nozzles (not shown) arranged approximately on a line in conveying direction X of the recording medium P. The nozzle surface is arranged such that it faces the recording surface of the recording medium P conveyed on the platen 2 during image recording.

Each recording head 31 is provided with a jetting unit 311 (refer to FIG. 3) such as a piezoelectric element therein. The plural recording heads 31 individually jet ink droplets from the respective discharging openings by the operation of the jetting unit 311, and the ink droplets reach the recording medium P to form an image.

The recording heads 31*a* to 31*d* express the tones in an image by a density modulation method. Herein, the density modulation method changes the density of each pixel of an image, namely, the quantity of droplets of ink to be jetted to a single pixel. In other words, tones in a formed image on the recording medium P change with changes in the ink jetting amounts from the discharging openings of the recording heads 31*a* to 31*d*. Further, the modulation expression of an image may be performed by a combination with an area coverage modulation method such as dithering or an error diffusion method, for example.

Herein, "ink" used in the present embodiment will be described.

As inks used in the present embodiment, particularly, it is possible to apply inks suitable for "a curing system using photoacid/base generator (Section 1)" and "photoinductive alternate copolymerization (Section 2)" in "photo-curing system (Chapter 4)" described in "photo-cure technology—selection and compound condition of a resin and initiator and measuring/evaluation of hardness—(GIJUTSU KYOKAI JOHO)", wherein inks which are cured by common radical polymerization may be applied.

Concretely, inks used in the present embodiment are UV curable inks having a characteristic of getting cured by irradiating UV light as a light and containing at least a polymerization compound (including known polymerization compounds), a photo initiator, and a color material, as main components. However, for an ink used in the present embodiment, a photo initiator may be excluded in a case of using an ink suitable for "photoinductive alternate type copolymerization (Section 2)" described above.

The above described photo-curable inks can be broadly categorized into radical polymerization inks containing a radial polymerization compound and cation polymerization inks containing a cation polymerization compound, wherein both types of inks are respectively applicable as inks to be used in the present embodiment, and further, a hybrid type ink in a mixture of a radial polymerization ink and a cation polymerization ink may be applied.

However, cation polymerization inks, which are less inhibited by polymerization reaction by oxygen, have advantages in functionality and versatility, and therefore particularly used in the present embodiment.

Cation polymerization inks used in the present embodiments are specifically a mixture at least containing a cation polymerization compound such as an oxetane compound, epoxy compound, vinyl ether compound, photo-cation initiator, and a color material, and has a characteristic of being cured by irradiation of UV light as described above.

The light emitters 32 are disposed in a quantity of two in such a manner that the light emitters 32 sandwich the plural recording heads 31*a* to 31*d* in scanning direction Y of the carriage 33. Specifically, the light emitters 32*a* and 32*b* are disposed respectively on the right side of the recording head 31*a* corresponding to the ink black (K) and on the left side of the recording head 31*b* corresponding to the ink yellow (Y) in FIG. 2.

The respective light emitters 32 are provided with plural light sources (not shown), for example, capable of emitting UV light. During image recording, onto an image formed by jetting ink from a recording head 31 onto the recording surface of the recording medium P, UV light is irradiated from a light emitter 32 disposed on the downstream side of the carriage 31 in scanning direction Y of the carriage 33. Specifically, when the carriage 33 moves in one direction in scanning direction Y, in other words, when the carriage 33 moves to the right in FIG. 2, the light emitter 32*b* disposed at the left end of the carriage 33 in FIG. 2 emits UV light onto an image formed on the recording medium, while the carriage 33 moves in the opposite direction in scanning direction Y, in mother words, when the carriage 33 moves to the left in FIG. 2, the light emitter 32*a* disposed at the right end of the carriage 33 in FIG. 2 emits UV light onto an image formed on the recording medium.

Thus, an image is cured on the recording surface, and the image is recorded on the recording surface.

As a light source, for example, a low pressure mercury lamp, high pressure mercury lamp, metal halide lamp, hot-cathode tube, cold-cathode tube, light emitting diode, semiconductor laser, etc. can be applied.

Next, the control device 4 will be described, referring to FIGS. 3 to 7 in detail.

Figure 3:
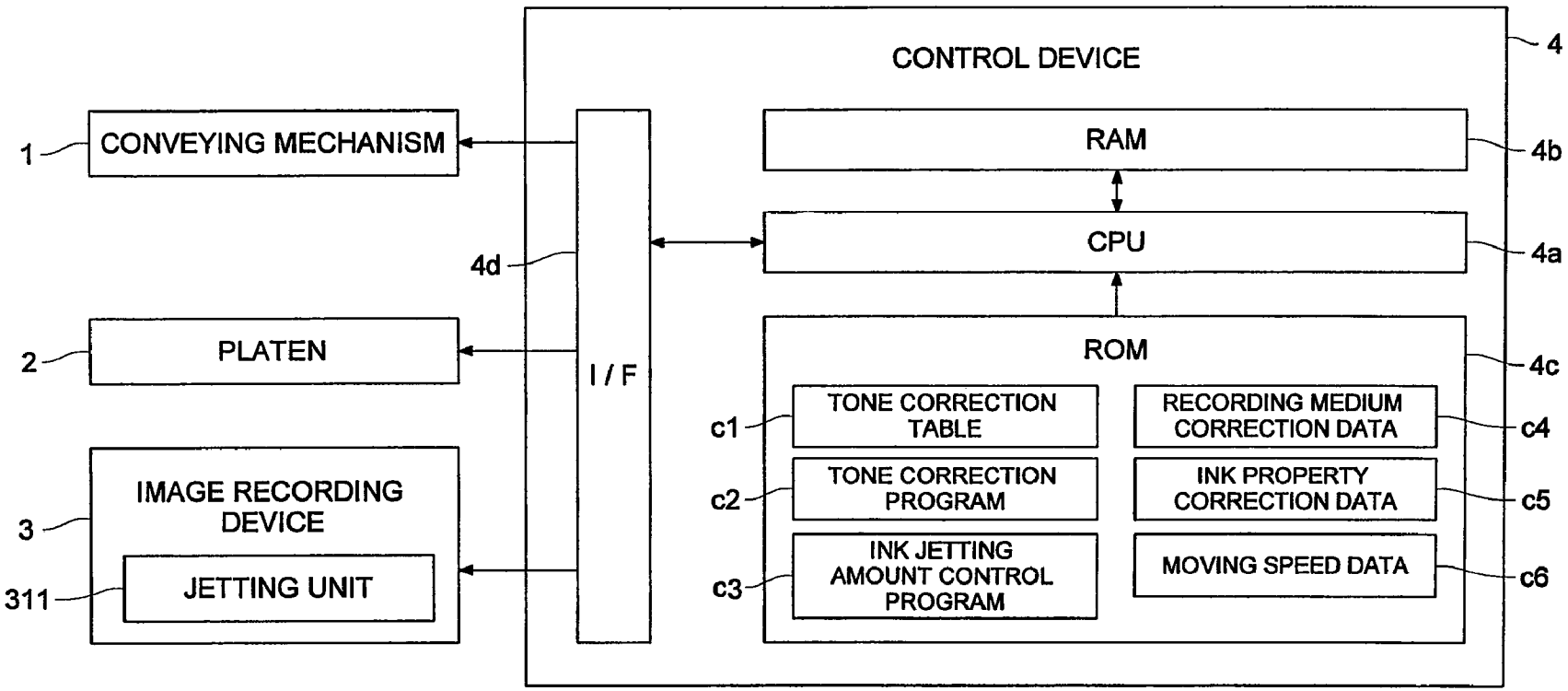
FIG. 3 is a function block diagram showing a main structure of a control device of the inkjet printer in FIG.
Figures 7, 8:
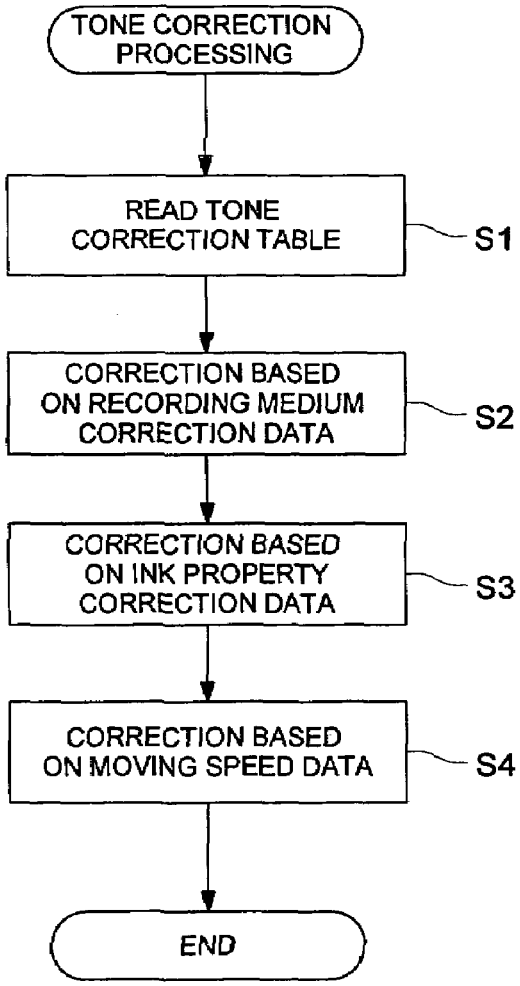
FIG. 7 is a diagram specifically showing contents of information of moving speed data related to the tone correction processing by the inkjet printer in FIG. 1.
FIG. 8 is a flowchart describing the tone correction processing by the inkjet printer in FIG. 1.

FIG. 3 is a function block diagram showing the main structure of the control device 4. FIG. 4 is a diagram showing a tone correction table c1. FIG. 5 is a diagram showing the correspondence between the component materials of the recording medium P and correction coefficients of image data, based on recording medium correction data c4. FIG. 6 is a diagram showing the correspondence between the properties of inks and the correction coefficients of tones of image data, based on ink property correction data c5. FIG. 7 is a diagram showing the correspondence between moving speeds of the carriage 33 and correction coefficients of image data, based on a moving speed data c6.

As shown in FIG. 3, the control device 4 includes a CPU (central processing unit) 4*a*, a RAM (random access memory) 4*b*, a ROM (read only memory) 4*c*, an interface (I/F) 4*d*, etc. The control device 4 is electrically connected to the conveying mechanism 1, the platen 2, the image recording device 3, and the like.

The ROM 4*c* stores various control programs (not shown) related to operations of respective parts of the inkjet printer 100, the tone correction table c1, tone correction program c2, ink jetting amount control program c3, and the like.

Herein, the modulation correction table c1 includes tone correction characteristic data related to tone correction of image data of an image recorded on the recording medium P. The tone correction characteristic data is specifically correspondence between input image signal levels (input values) of YMCK data of a predetermined number of bits indicating the brightness of the Y, M, C, K components of each pixel included in image data, and D/A input levels (output values) of Y', M', C', and K' data of which tones have been corrected, according to these input image signal levels. In the present embodiment, the input image signal levels are expressed in density levels from 0 to 255, while the D/A input levels are expressed in density levels 0.0 for white level and 1.0 for black level.

The ROM 4*c* stores control data (not shown) related to execution of the various programs described above, the recording medium correction data c4, the ink property correction data c5, the moving speed data c6, and the like.

Herein, the recording medium correction data c4 is data in which correction amounts of tones in image data are specified, based on the component materials of the recording medium P. Concretely, corresponding to component materials (for example, component materials A to D) of the recording medium P, the recording medium correction data c4 specifies, as shown in FIG. 5 for example, predetermined correction coefficients (for example, a correction coefficient 1.00 for a component material A, a correction coefficient 0.95 for a component material B, a correction coefficient 0.75 for a component material C, and a correction coefficient 0.90 for a component material D).

Further, the ink property correction data c5 specifies correction amounts of tones in image data, based on the properties of inks, as shown in FIG. 6.

Still further, the moving speed data c6 is related to the moving speed of the carriage 33, as shown in FIG. 7.

Incidentally, the recording medium correction data c4 and the ink property correction data c5 are specified, respectively based on the wettablility of a recording medium and the wettability of an ink.

The RAM 4*b* is capable of storing plural inputted data only during the time when power is supplied, and is provided with a work area for the CPU 4*a*, a storage area for storing image data for instructing image recording on the recording medium P, and the like.

Herein, image data may be input from a control device or the like connected to the inkjet printer 100 thorough, for example, a certain communication means wired or wireless, or may be recorded in a certain storage medium such as an optical disk, for example, and read by a certain reading device.

The CPU 4*a* expands a program, designated from various programs stored in the ROM 4*c*, in a work area in the RAM 4*b* and executes various processings in accordance with the program.

Specifically, the CPU 4*a* executes the tone correction program c2 to enable tone correction processing for correcting tones in image data. In this tone correction processing, the CPU 4*a*, as the tone correction means and based on tone correction characteristic data in the tone correction table c1, first corrects the tones of the image data formed on the recording medium P such that a difference is made between the tone values of an image formed during forward moving of the carriage in one direction along scanning direction and the tone values of an image formed during backward-moving of the carriage in the opposite direction along the scanning direction.

Next, in the tone correction processing, based on the recording medium correction data c4, the CPU 4*a* corrects the tones of the image data of which tones have been corrected based on the tone correction characteristic data in the tone correction table c1.

Further, in the tone correction processing, based on the ink property correction data c5, the CPU 4*a* corrects the tones of the image data of which tones have been corrected based on the recording medium correction data c4.

Still further, in the tone correction processing based on the moving speed data c6, the CPU 4*a* corrects the tones of the image data of which tones have been corrected based on the ink property correction data c5.

During image recording, as ink jetting amount control means and based on the image data of which tones have been corrected according to the moving speed data c6, the CPU 4*a* controls the ink jetting amounts to be jetted from the discharging openings of the plural recording heads 31*a* to 31*d*, namely, the quantity of ink droplets to be jetted onto a single pixel, by executing the ink jetting amount control program c3. Further, the recording medium correction data c4, the ink property correction data c5, and the moving speed data c6 may be reflected in the recording rate in performing multi-value processing of the image to fit the characteristics of a recording device.

Herein, ink jetting amounts are controlled in the present embodiment in such a manner that respective ink jetting amounts to be jetted in plural colors are changed depending on whether the inks are jetted during forward moving or during backward moving of the carriage 33. As an example of patterns, if M ink jetted first and Y ink jetted second superimposedly have been jetted in the same amount during forward moving (moving to the right) of the carriage, then, during backward moving (moving to the left) of the carriage, M ink to be jetted second is jetted in a smaller amount than that for Y ink to be jetted first in order to form the same color during backward moving of the carriage as the color formed during forward moving of the carriage. Thus, a color formed by jetting inks during forward moving in a jetting order (K→C→M→Y) and a color formed by jetting inks during backward moving in a jetting order (Y→M→C→K) can be made to look the same.

Further, depending on the wettabilities of a recording medium and inks, ink jetting amounts are controlled to change. For example, if the wettabilities of a recording medium and inks are higher than predetermined reference values, an ink jetted later superimposedly tends to spread, and therefore, an ink to be jetted later is jetted in a smaller jetting amount. On the other hand, if the wettabilities of a recording medium and inks are lower than predetermined reference values, an ink jetted later superimposedly does not tend to spread, and therefore, an ink to be jetted later is jetted in a larger jetting amount.

Further, ink jetting amounts are changed, corresponding to the relative moving speed between the plural recording heads and the recording medium (namely, the speed of the carriage in the present embodiment). For example, if the moving speed is higher than a reference speed, the time period from when ink lands on the recording medium until when the ink is cured by a light emitter is short, which inhibits the ink from spreading on the recording medium. Therefore, the ink jetting amount is set larger in order to adjust the dot diameter to become the same, even for a shorter time of curing, as in the case of a lower moving speed. On the other hand, if the moving speed is lower than a reference speed, the time period from when ink reaches the recording medium until when the ink is cured by a light emitter is long, by which the ink tends to spread on the recording medium. Therefore, the ink jetting amount is set smaller in order to adjust the dot diameter to become the same as in the case of a lower moving speed, even for a longer time of curing.

Next, the tone correction processing under the control of the control device 4 will be described, referring to FIG. 8. Herein, FIG. 8 is a flowchart for explaining the tone correction processing.

First, based on predetermined operations by the user, when recording of an image on a recording medium P is instructed, the CPU 4*a* executes the tone correction processing on the image data of an image. In other words, the CPU 4*a* first executes the tone correction program c2 to read the tone correction table c1 stored in the ROM 4*c* and expand it in a predetermined work area in the RAM 4*b* (step S1). Then, based on the tone correction characteristic data in the tone correction table c1, the CPU 4*a* corrects the tones of the image data stored in the RAM 4*b* to D/A input levels corresponding to input image signal levels. Thus, the image data is converted from YMCK data into Y'M'C'K' data.

Next, the CPU 4*a* reads the recording medium correction data c4 from the ROM 4*c*, and performs a predetermined computation based on the recording medium correction data c4, thereby correcting the tones, of the image data, having been corrected based on the tone correction table c1 (step S2).

The computed image data is temporarily stored in a predetermined area of the storage area of the RAM 4*b*, under the control of the CPU 4*a*.

Further, the CPU 4*a* reads the ink property correction data c5 from the ROM 4*c*, and performs a predetermined computation, based on the ink property correction data c5, thereby correcting the tones, of the image data, having been corrected based on the recording medium correction data c4 (step S3).

The computed image data is temporarily stored in a predetermined area of the storage area of the RAM 4*b* under the control of the CPU 4*a*.

Further, the CPU 4*a* reads the moving speed data c6 from the ROM 4*c* and performs a predetermined computation, based on the moving speed data c6, thereby correcting the tones, of the image data, having been corrected based on the ink property correction data c5 (step S4).

The computed image data is temporarily stored in a predetermined area in the RAM 4*b* under the control of the CPU 4*a*.

As described above, the CPU 4*a* can optimize the tone characteristics of the image data by performing the tone correction processing.

Next, the CPU 4*a* performs a control to perform predetermined processing including error diffusion processing on the image data of which tone have been optimized, and then, as ink jetting amount control means and based on the image data on which the predetermined processing has been performed, the CPU 4*a* controls the ink jetting amounts to be jetted from the discharging openings of the nozzles of the recording heads 31*a* to 31*d*, that is, the quantity of ink droplets to be jetted onto a single pixel. Further, the recording medium correction data c4, the ink property correction data c5, and the moving speed data c6 may be reflected in the recording rate in performing multi-value processing on the image to fit the characteristics of the recording device.

As described above, the inkjet printer 100 in the present embodiment includes plural recording heads for jetting inks of plural kinds onto a recording medium, light emitters for irradiating light onto ink having reached the recording medium, a carriage that reciprocally moves in the scanning direction orthogonal to the conveying direction of the recording medium and has the plural recording heads and the light emitters thereon parallel to the scanning direction, and a control device that performs a control to jet inks from plural recording heads during forward moving and backward moving of the carriage and to change the ink jetting amounts to be jetted from the recording heads depending on whether the carriage is in forward moving or in backward moving so that the same color is formed in the both moving directions of the carriage, namely, forward moving and backward moving. Thus, the inkjet printer can form the same colors during forward moving and backward moving.

In the present embodiment, under the control of the control device, in one scanning while the carriage is moving forward, recording heads jet ink onto a recording medium which has ink cured already and a light emitter cures the later jetted ink, and further, in one scanning while the carriage is moving backward, the recording heads jet ink on the recording medium which has ink cured already and a light emitter cures the later jetted ink. These operations are repeated to form an image, wherein an ink jetting amount is controlled to be changed depending on the moving direction of the carriage, namely, the forward direction or the backward direction, corresponding to the wettabilities of the inks. In such a manner, the same color can be securely formed during both forward moving and backward moving.

Further, in the present embodiment, the control device performs control to correct the tones of image data, corresponding to the wettabilities of the inks and the recording medium. Thus, the same color can be further securely formed during both forward moving and backward moving, particularly for halftones.

Still further, in the present embodiment, the control device performs control to correct the tones of image data, corresponding to the moving speed of the carriage. Thus, the same color can be further securely formed during both forward moving and backward moving.

As a result of the above, in the present embodiment, the inkjet printer can form the same colors commonly during forward moving and backward moving of the carriage so as to form desirable images.

The invention is not limited to the foregoing embodiment and various changes and modifications may be made without departing from the spirit or scope of the invention.

For example, although in the present embodiment, a serial type printer is employed as an inkjet printer, the invention is not limited to this, and a line type or a drum type may be used as an inkjet printer.

Further, although inks (including radical polymerization inks, cation polymerization inks, and hybrid type inks) used in the above embodiment are cured by irradiating UV light, the inks are not limited to this, and inks cured by irradiating light other than UV light may be employed. Herein, the word "light" is used in a broad sense, including electromagnetic waves such as UV ray, electron ray, X ray, visible light, infrared ray. In other words, as inks to be used in the above embodiment, it is possible to apply a polymerization compound which is cured by being polymerized by light other than UV light and a photo initiator that initiates polymerization reaction between polymerization compounds by light other than UV light. To use photo-curable inks that can be cured by light other than UV light in the above embodiment, a light source for emitting such light is necessary to be applied for a light emitter in accordance with the invention.

Still further, although in the above embodiment, recording heads 31*a* to 31*d* corresponding to the respective inks of black (K), cyan (C), magenta (M), and yellow (Y) are provided, the quantity of recording heads 31 and colors of inks jetted from the recording heads 31 can be changed properly and arbitrarily as long as at least two recording heads 31 are provided.

What is claimed is:

1. An inkjet printer comprising:

a plurality of recording heads for jetting inks of a plurality of kinds onto a recording medium;

a light emitting device for irradiating light onto ink having reached the recording medium;

a driving device for moving the plurality of recording heads and the recording medium relatively and bidirectionally; and a control device for performing control to form an image by controlling the plurality of recording heads to jet ink while moving the plurality of recording heads and the recording medium relatively in one direction and in an opposite direction, and changing ink jetting amounts to be jetted from the respective recording heads, depending on whether jetting ink while the recording heads are moving in the one direction or in the opposite direction, so that a same color is formed in both of the moving directions of the recording heads, wherein the control device performs control such that at least one of the plurality of recording heads jets a first ink directly onto the recording medium and the light emitting device cures the first ink while the plurality of recording heads and the recording medium are relatively moving in the one direction, and such that at least one of the plurality of recording heads jets a second ink onto the recording medium having the already cured first ink thereon and the light emitting device cures the second ink while the plurality of recording heads and the recording medium are relatively moving in the opposite direction; and wherein the control device changes an ink jetting amount depending on whether jetting the ink while the recording heads are moving in the one direction or in the opposite direction, corresponding to respective ink wettabilities and a wettability of the recording medium.

2. The inkjet printer of claim 1, wherein the control device performs control to make diameters of ink dots, based on dot data representing the same color and a same tone, to be approximately uniform on the recording medium and on an already cured ink.

3. The inkjet printer of claim 1, wherein the control device performs control to correct tones of image data, corresponding to the respective ink wettabilities and the wettability of the recording medium.

4. The inkjet printer of claim 1, wherein the control device performs control to change the ink jetting amounts depending on whether jetting the inks while the recording heads are moving in the one direction or in the opposite direction, corresponding to a relative moving speed between the plurality of recording heads and the recording medium.

5. An inkjet printer comprising:

a plurality of recording heads for jetting inks of a plurality of kinds onto a recording medium;

a light emitting device for irradiating light onto ink having reached the recording medium;

a driving device for moving the plurality of recording heads and the recording medium relatively and bidirectionally; and a control device for performing control to form an image by controlling the plurality of recording heads to jet ink while moving the plurality of recording heads and the recording medium relatively in one direction and in an opposite direction;

wherein the control device performs control such that at least one of the plurality of recording heads jets a first ink directly onto the recording medium and the light emitting device cures the first ink while the plurality of recording heads and the recording medium are relatively moving in the one direction, and such that at least one of the plurality of recording heads jets a second ink onto the recording medium having the already cured first ink thereon and the light emitting device cures the second ink while the plurality of recording heads and the recording medium are relatively moving in the opposite direction; and wherein the control device controls an ink jetting amount of the first ink in accordance with a wettability of the recording material in the one direction and in accordance with a wettability of the already cured first ink in the opposite direction.

6. An inkjet printer according to claim 5, wherein the control device performs control to change an ink jetting amount on a part not carrying an already jetted and cured ink on the recording medium in accordance with the wettability of the recording medium in the opposite direction.

7. An inkjet printer according to claim 5, wherein the control device performs control to change an ink jetting amount on a part carrying an already jetted and cured ink on the recording medium in accordance with a wettability of the already jetted and cured ink in the one direction.

8. An inkjet printer comprising:

a plurality of recording heads for jetting inks of a plurality of kinds onto a recording medium;

a light emitting device for irradiating light onto ink having reached the recording medium;

a driving device for moving the plurality of recording heads and the recording medium relatively and bidirectionally; and a control device for performing control to form an image by controlling the plurality of recording heads to jet ink while moving the plurality of recording heads and the recording medium relatively in one direction and in an opposite direction, wherein the control device performs control such that at least one of the plurality of recording heads jets a first ink directly onto the recording medium and the light emitting device cures the first ink while the plurality of recording heads and the recording medium are relatively moving in the one direction, and such that at least one of the plurality of recording heads jets a second ink onto the recording medium having the already cured first ink thereon and the light emitting device cures the second ink while the plurality of recording heads and the recording medium are relatively moving in the opposite direction; and wherein the control device performs control to change an ink jetting amount on a part not carrying an already jetted and cured ink on the recording medium in accordance with the wettability of the recording medium, and to change an ink jetting amount on a part carrying an already jetted and cured ink on the recording medium in accordance with a wettability of the already jetted and cured ink.

* * * * *